US007625187B2

(12) United States Patent
Collins et al.

(10) Patent No.: US 7,625,187 B2
(45) Date of Patent: Dec. 1, 2009

(54) SUBMERSIBLE PUMP WITH INTEGRATED LIQUID LEVEL SENSING AND CONTROL SYSTEM

(75) Inventors: Michael Collins, DesPlaines, IL (US); Gerald A. Assessor, St. Charles, IL (US)

(73) Assignee: Johnson Pumps of America Inc., Schiller Park, IL (US)

( * ) Notice: Subject to any disclaimer, the term of this patent is extended or adjusted under 35 U.S.C. 154(b) by 326 days.

(21) Appl. No.: 11/210,340

(22) Filed: Aug. 24, 2005

(65) Prior Publication Data

US 2007/0048157 A1 Mar. 1, 2007

(51) Int. Cl.
*F04B 49/00* (2006.01)

(52) U.S. Cl. ..... 417/36; 417/44.1; 417/360

(58) Field of Classification Search ..... 417/36, 417/44.1, 423.3, 37, 38, 39, 40, 41, 238, 417/360

See application file for complete search history.

(56) References Cited

U.S. PATENT DOCUMENTS

| | | | | |
|---|---|---|---|---|
| 3,715,539 | A | 2/1973 | Silberg et al. | |
| 4,749,988 | A | 6/1988 | Berman et al. | |
| 4,870,292 | A * | 9/1989 | Alpert et al. | 250/577 |
| 5,257,911 | A * | 11/1993 | Mota et al. | 417/63 |
| 5,425,624 | A * | 6/1995 | Williams | 417/36 |
| 5,594,222 | A | 1/1997 | Caldwell | |
| 6,164,132 | A | 12/2000 | Matulek | |
| 6,192,752 | B1 * | 2/2001 | Blaine | 73/290 R |

(Continued)

FOREIGN PATENT DOCUMENTS

| | | |
|---|---|---|
| WO | WO 98/00643 | 1/1998 |

(Continued)

OTHER PUBLICATIONS

Infrared. (Mar. 30, 2008). In Wikipedia, The Free Encyclopedia. Retrieved 16:04, Mar. 31, 2008, from http://en.wikipedia.org/w/index.php?title=Infrared&oldid=201999918.*

(Continued)

*Primary Examiner*—Devon C Kramer
*Assistant Examiner*—Leonard J Weinstein
(74) *Attorney, Agent, or Firm*—Nixon Peabody LLP

(57) ABSTRACT

In accordance with one embodiment of the present invention, there is provided a submersible pump that includes a pump housing forming a main compartment for receiving a pump impeller and having liquid entrance and exit openings in said main compartment, and an impeller mounted in the main compartment. The pump housing is adapted for submersion in a body of liquid whose level is to be controlled, and a sealed auxiliary compartment is formed as an integral part of the housing and located to be at least partially submerged in the liquid body. A drive motor is coupled to the impeller for rotating the impeller to eject liquid from the main compartment through the exit opening. An electric-field sensor is mounted in the sealed auxiliary compartment for detecting the elevation of the surface of the liquid body adjacent the sealed auxiliary compartment. At least one controllable switch is connected in the power supply line for controlling the supply of power to the drive motor, and the electric-field sensor is connected to the controllable switch for opening and closing the switch in response to changes in the detected elevation of the surface of the liquid body adjacent the outer surface of the sealed auxiliary compartment.

13 Claims, 9 Drawing Sheets

U.S. PATENT DOCUMENTS

| | | | | |
|---|---|---|---|---|
| 6,310,611 | B1 | 10/2001 | Caldwell | |
| 6,320,282 | B1 | 11/2001 | Caldwell | |
| 6,479,915 | B2 * | 11/2002 | Hsueh | 310/87 |
| 6,538,261 | B1 * | 3/2003 | McConnel et al. | 250/577 |
| 7,264,449 | B1 * | 9/2007 | Harned et al. | 417/36 |
| 7,373,817 | B2 * | 5/2008 | Burdi et al. | 73/290 R |
| 2002/0176782 | A1 | 11/2002 | Batchelder et al. | |
| 2002/0190868 | A1 | 12/2002 | Dearborn et al. | |
| 2003/1001705 | * | 1/2003 | Fong | 417/44.9 |
| 2003/0091440 | A1 | 5/2003 | Patel et al. | |
| 2004/0018094 | A1 | 1/2004 | Rossman | |
| 2004/0035471 | A1 * | 2/2004 | Harwood | 137/565.29 |
| 2004/0191090 | A1 * | 9/2004 | Patel et al. | 417/360 |
| 2005/0068049 | A1 * | 3/2005 | Steenwyk | 324/713 |

FOREIGN PATENT DOCUMENTS

| | | |
|---|---|---|
| WO | WO 03/042536 | 5/2003 |

OTHER PUBLICATIONS

Electric field. (Mar. 31, 2008). In Wikipedia, The Free Encyclopedia. Retrieved 17:41, Mar. 31, 2008, from http://en.wikipedia.org/w/index.php?title=Electric_field&oldid=202258860.*

* cited by examiner

FIG. 8
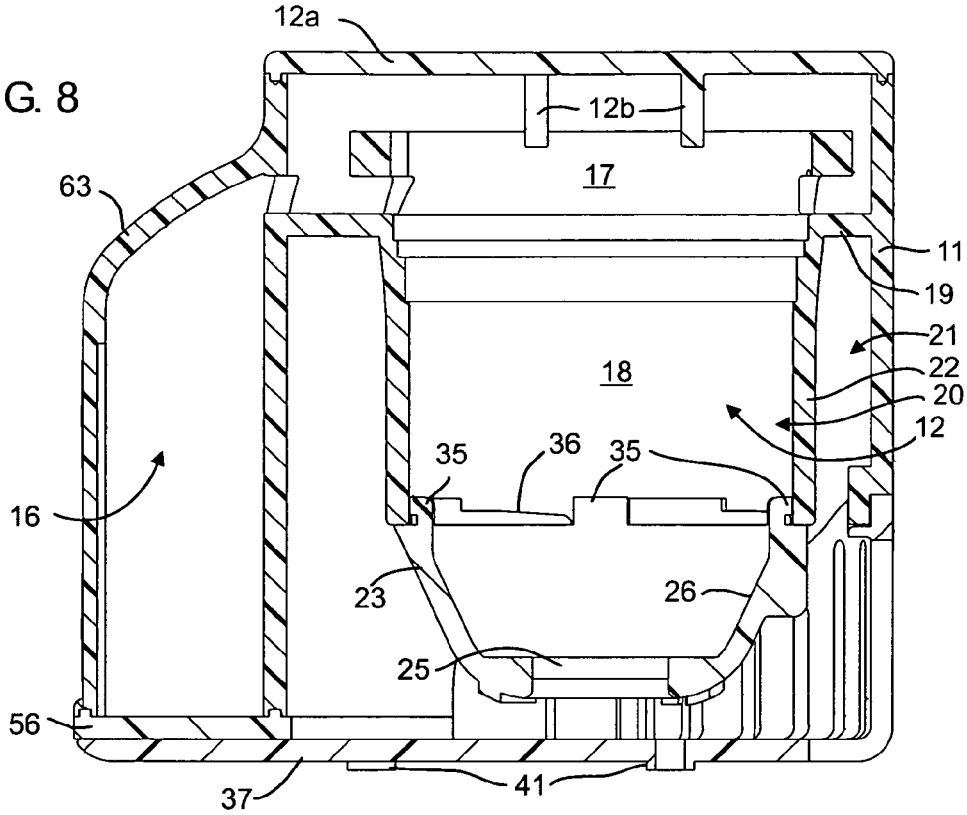
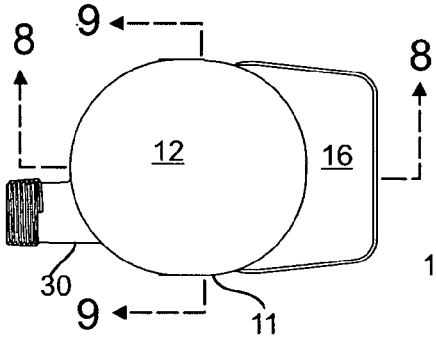
FIG. 7
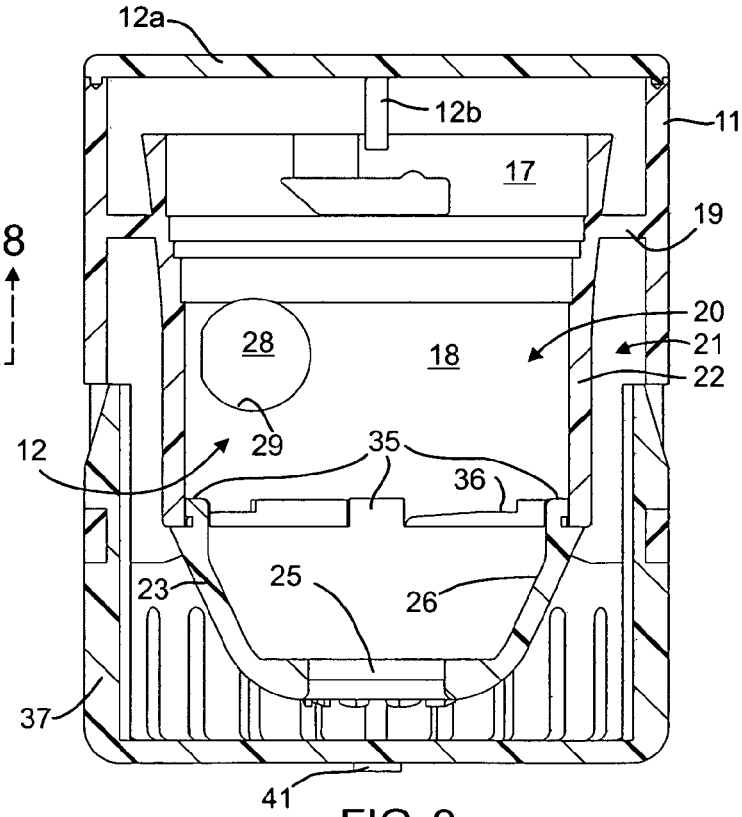
FIG. 9

SUBMERSIBLE PUMP WITH INTEGRATED LIQUID LEVEL SENSING AND CONTROL SYSTEM

FIELD OF THE INVENTION

The present invention relates generally to submersible pumps and, more particularly, to submersible pumps having integrated liquid-level sensing and control systems.

SUMMARY OF THE INVENTION

In accordance with one embodiment of the present invention, there is provided a submersible pump that includes a pump body forming a main compartment for receiving a drive motor and having liquid intake and discharge openings. The pump body is adapted for submersion in a body of liquid whose level is to be controlled, and a sealed auxiliary compartment is formed as an integral part of the housing and located to be at least partially submerged in the liquid body. The drive motor is coupled to an impeller for ejecting liquid from the main compartment through the exit opening. An electric-field sensor is mounted in the sealed auxiliary compartment for detecting the elevation of the surface of the liquid body adjacent the sealed auxiliary compartment. A controllable switch is coupled to a pair of electrical conductors for coupling the electric-field sensor and drive motor to a power supply. The controllable switch controls the supply of electrical power to the drive motor, and the electric-field sensor is connected to the controllable switch for turning the drive motor on and off in response to changes in the detected elevation of the surface of said liquid body adjacent the outer surface of said sealed auxiliary compartment.

One particular embodiment includes a pair of electric-field sensors located at different elevations. The upper sensor produces a signal that turns the drive motor on after the surface of the liquid body rises to a first predetermined elevation, and the lower sensor produces a signal that turns the drive motor off after the surface of the liquid body drops to a second predetermined elevation. The turning on of the drive motor is preferably delayed by a predetermined delay interval following the detection of the rising of the surface of the liquid body to the first predetermined elevation.

BRIEF DESCRIPTION OF THE DRAWINGS

FIG. 7 is a diagrammatic plan view of the body of the pump of FIG. 1;

FIG. 8 is a section taken along line 8-8 in FIG. 7;

FIG. 9 is a section taken along line 9-9 in FIG. 7;

DETAILED DESCRIPTION OF ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Figure 1:
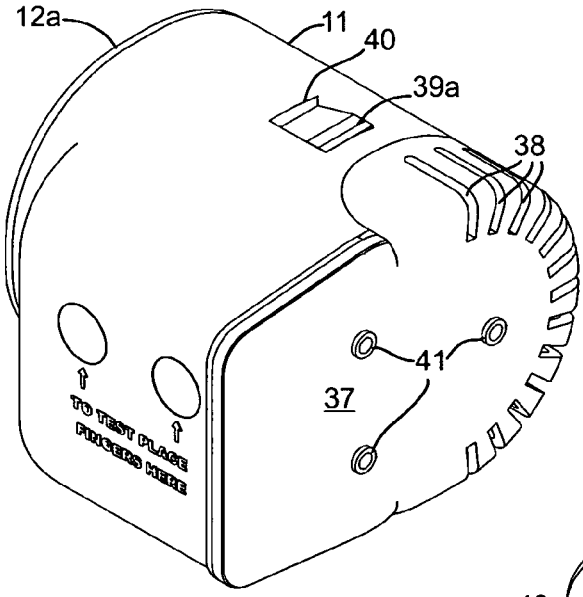
FIG. 1 is a bottom perspective from one side of one embodiment of a submersible pump embodying the invention.
Figure 2:
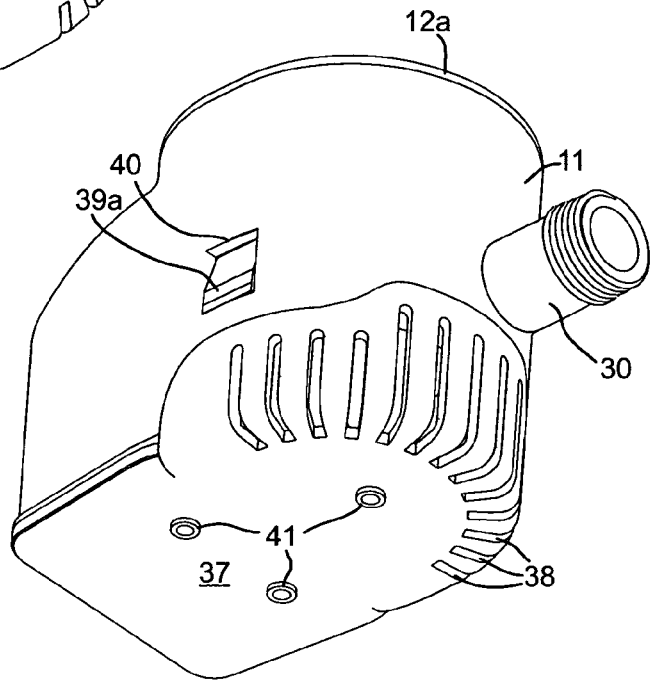
FIG. 2 is a bottom perspective from the opposite side of the pump of FIG. 1.
Figure 3:
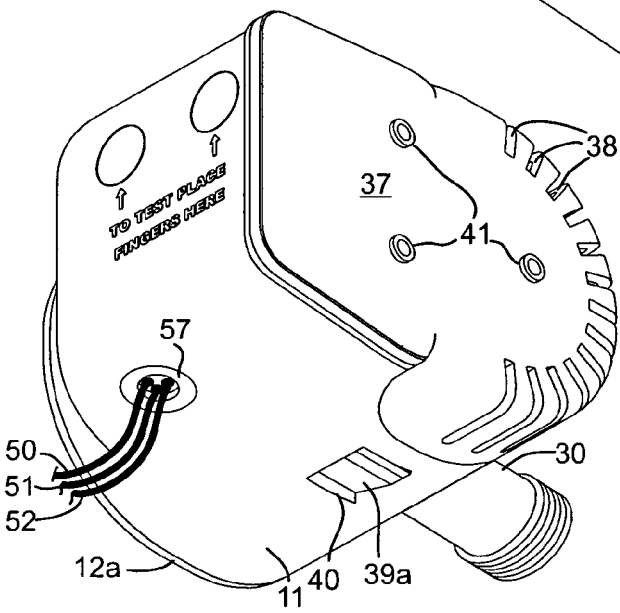
FIG. 3 is a top perspective of the pump of FIG. 1 from the same side shown in FIG. 1.
Figure 4:
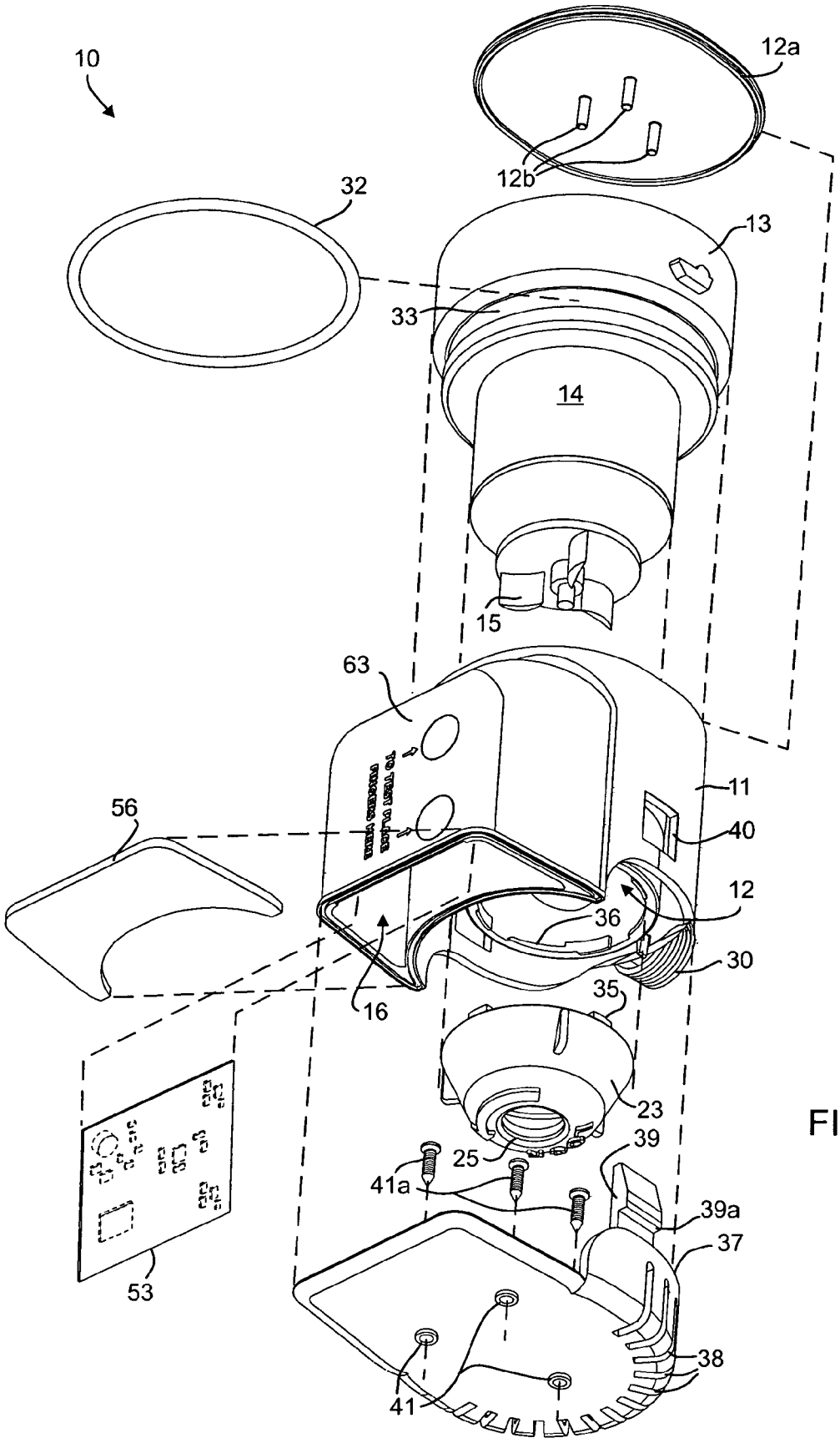
FIG. 4 is an exploded perspective of the pump of FIG. 1.
Figure 5:
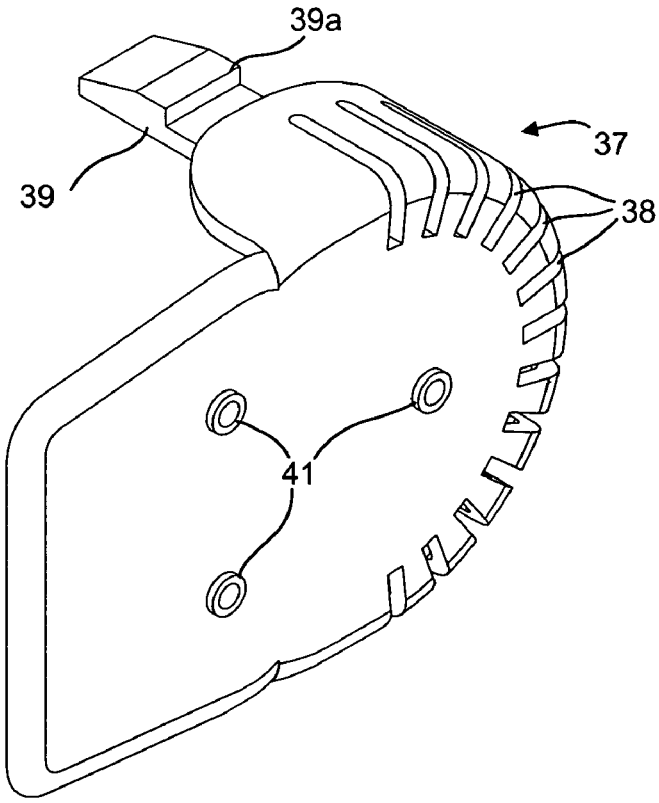
FIG. 5 is a bottom perspective of the strainer in the pump of FIG. 1.

Turning now to the drawings and referring initially to FIG. 1, a submersible pump 10 includes a body 11 forming a main compartment 12 for receiving a drive motor 13. The lower portion of the motor 13 is encased in a liquid-impervious housing 14. The output shaft of the motor 13 extends downwardly through a sealed aperture in the bottom wall of the housing 14 and is attached to an impeller 15. The pump body 11 also forms an integral auxiliary compartment 16 for receiving electrical sensing, switching and control components.

The main compartment 12 is divided into upper and lower regions 17 and 18 (see FIGS. 8 and 9) by an annular wall 19 formed as an integral part of the pump body 11. The lower region 18 in turn is partitioned into inner and outer regions 20 and 21 by an inner cylinder 22 extending downwardly from the inner edge of the wall 19. The motor housing 14 extends downwardly through the inner region 20 so that the impeller 15 is positioned inside a volute 23 attached to the lower end of the cylinder 22. When the pump is submerged in a body of liquid to be pumped, the liquid enters a cavity 24 between the impeller 15 and the volute 23 through a central aperture 25 in the bottom wall of the volute. Then when the impeller 15 is driven by the motor 13, the liquid in the cavity 24 is driven upwardly along the inside wall 26 of the volute into an annular portion of the inner region 20 between the cylinder 22 and the motor housing 14, and then outwardly through a discharge port 28 in the cylinder 22. The discharge port 28 is the opening into a conduit 29 formed as an integral part of the pump body 11. The conduit 29 extends through the annular region 21 and terminates in an outwardly extending spout 30.

The upper end of the cavity 27 is closed by a flange 31 extending outwardly from the motor housing 14, and is sealed by an O-ring 32 mounted in a groove in the outer surface of the motor housing 14 above the flange 31. The O-ring 32 is formed of a resilient material and is dimensioned to press against a step in the inside surface of the cylinder 22, thereby forming a tight seal between the opposed walls of the cylinder 22 and the motor housing 14. This seal prevents any liquid from entering the upper region 17 of the main compartment 12, where the electrical connections to the drive motor are located. After the drive motor 13 has been installed, the open upper end of the compartment 12 is closed by attaching a top plate 12*a* that is sealed (e.g., by ultrasonic bonding) to the lip of the open upper end of the compartment 12 to form a liquid-tight seal.

To facilitate access to the impeller 15, e.g., for cleaning or maintenance purposes, the volute 23 is detachably attached to the lower end of the cylinder 22. Specifically, the volute 23 has multiple flanged tabs 35 extending upwardly from the top edge of the volute 23 for engaging cooperating lugs 36 (see FIGS. 8 and 9) on the inside wall of the cylinder 22. When the volute 23 is rotated relative to the cylinder 22, the bottom surfaces of the flanges on the upper ends of the tabs 35 slide over the top surfaces of the lugs 36, which slope upwardly to form cam surfaces that draw the volute 23 upwardly against the cylinder 22.

Attached to the bottom of the pump body 11 is a strainer 37 through which liquid must pass to enter the volute 23. The strainer 37 includes multiple openings 38 that allow liquid to pass through the strainer while screening out solid material of a size larger than the openings 38. The strainer 37 is connected to the pump body 11 by a pair of flanged tabs 39 extending upwardly from the top edge of the strainer 37 and fitting into complementary apertures 40 in the outer wall of the pump body 11. The tabs 39 are resilient to allow them to flex laterally and slide along the outer surface of the pump body 11 as the strainer 37 is urged upwardly toward the bottom of the pump body 11. When the lower edges of the flanges 39*a* on the tabs 39 pass the lower edges of the apertures 40, the flanges 39 snap into the apertures 40, locking the strainer 37 in place on the pump body 11. To detach the strainer, the flanges 39 are simply pushed inwardly while urging the strainer 37 downwardly to move the lower edges of the flanges 39*a* below the lower edges of the apertures 40.

The strainer 37 has multiple holes 41 for receiving mounting screws 41*a* for attaching the pump to a suitable mounting surface 42. When the pump is installed in the bilge of a boat, for example, the mounting surface 42 is typically the surface of a board provided on the floor of the bilge to avoid any danger of penetration of the hull of the boat by the mounting screws. Each of the holes 41 is surrounded by a boss on the exterior surface of the bottom of the strainer 37.

Figure 6:
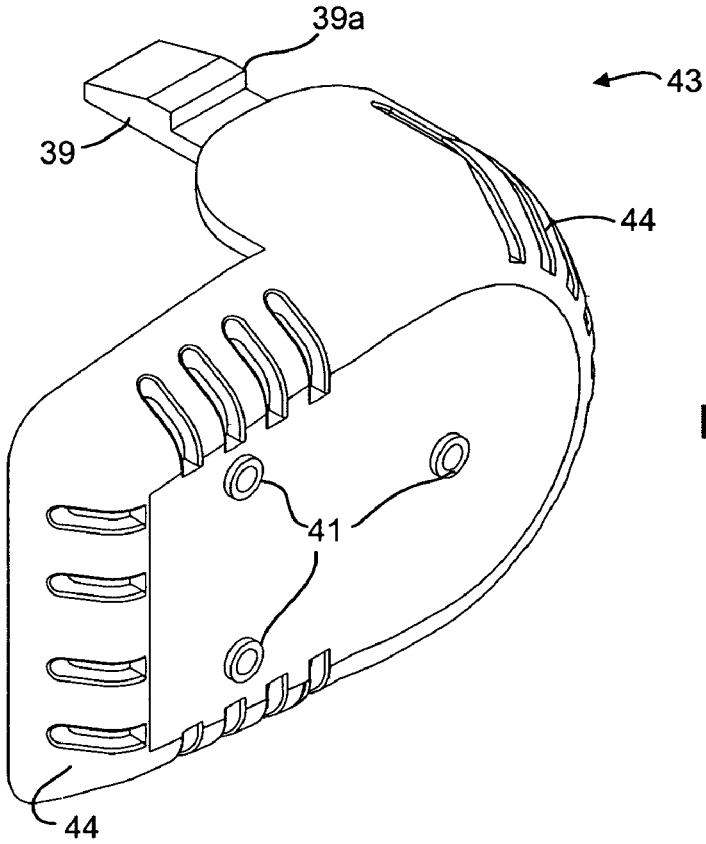
FIG. 6 is a bottom perspective of an alternative strainer for use in the pump of FIG. 1.

FIG. 6 illustrates an alternative strainer 43 that is taller than the strainer 37. The lower portion 44 of this alternative strainer 43 is tapered inwardly to reduce the size of the footprint of the strainer, to facilitate mounting of the pump in cramped spaces.

In the illustrative pump, the electric-field sensors and the drive motor are connected to a power supply (e.g., the battery B in FIG. 14) by three insulated wires 50, 51 and 52 and various components mounted on a printed circuit board 53 located in the auxiliary compartment 16. The auxiliary compartment 16 is totally enclosed except for two wiring apertures 54 and 55 and an open lower end through which the circuit board 53 is installed in the compartment. The circuit board 53 is coated with adhesive on its outer surface so that it can simply be adhered to the inside surface of the exterior wall of the auxiliary compartment 16. After the circuit board 53 has been installed, the open lower end of the compartment 16 is closed by attaching a bottom plate 56 that is sealed (e.g., by ultrasonic bonding) to the lip of the open end of the auxiliary compartment 16 to form a liquid-tight seal. A grommet 57 seals the external wiring aperture 54 so that liquid cannot enter the compartment 16 through this opening.

Figure 14:
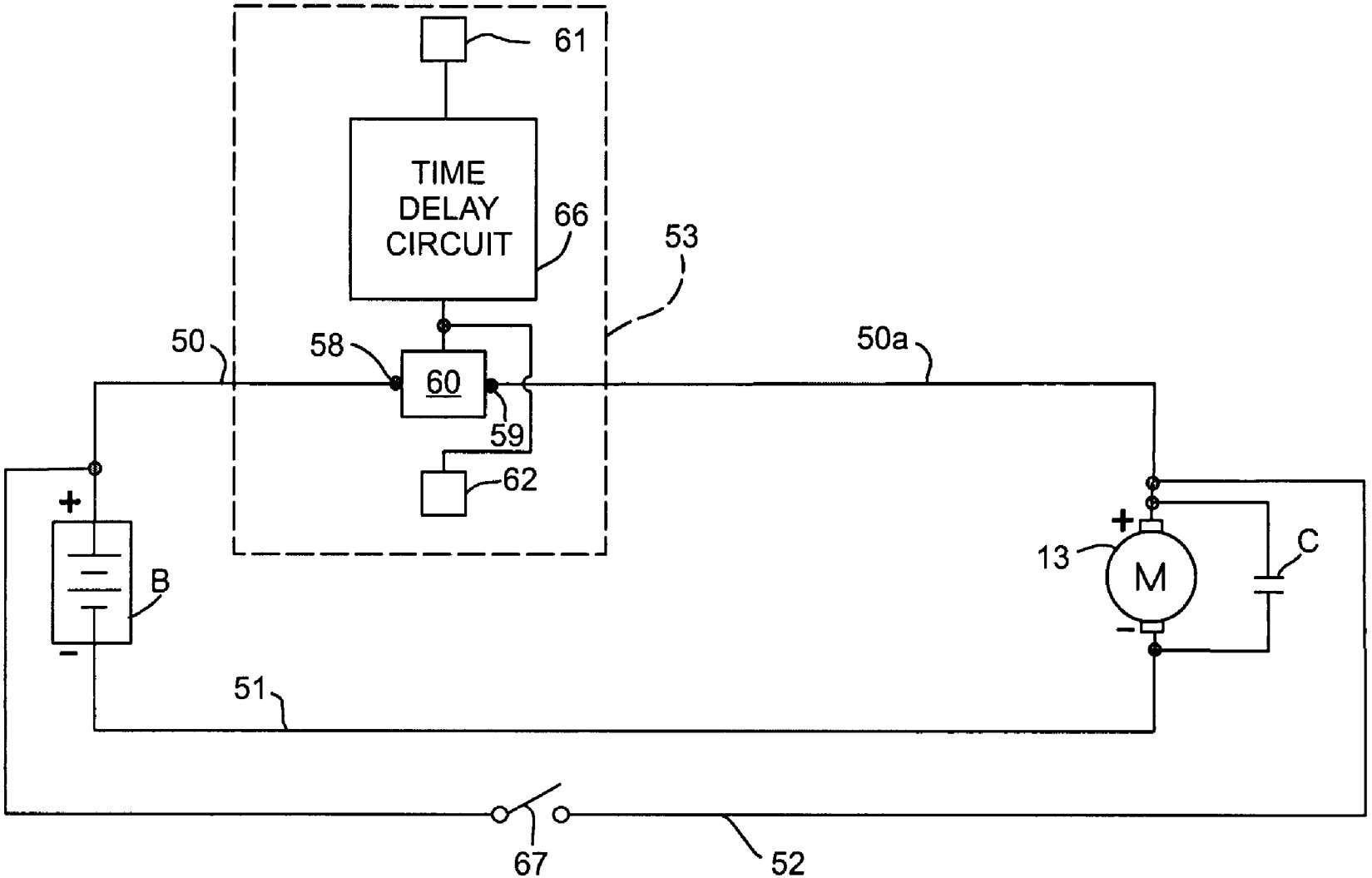
FIG. 14 is a schematic diagram of the electrical system included in the pump of FIG. 1.

As can be seen in the electrical schematic diagram in FIG. 14, the wire 50 is connected from the positive terminal of the power supply, presented in an exemplary embodiment as battery B, to a contact 58 (also referred to herein as "conductor") on the printed circuit board 53 to supply power to a controllable solid-state switch 60 (e.g., a field-effect transistor). A second wire 50*a* connects the other side of the switch 60, e.g., via an electrical coupling to contact/conductor 59 on the circuit board 53, to the positive terminal of the drive motor 13, so that the state of the switch 60 controls the supply of electrical power to the drive motor 13.

The state of the switch 60 is controlled by the output signals from two electric-field sensors 61 and 62. Specifically, the switch 60 turns the drive motor 13 on and off in response to changes in the detected elevation of the surface of the liquid body adjacent the outer surface of the sealed auxiliary compartment 16. The upper sensor 61 produces a signal that turns the drive motor 13 on after the surface of the liquid body rises to a first predetermined elevation (e.g., 2 inches above the bottom of the strainer 37), and the lower sensor 62 produces a signal that turns the drive motor off when the surface of said liquid body drops to a second predetermined elevation (e.g., 0.6 inch above the bottom of the strainer 37).

As can be seen in FIGS. 10-13 and 17, the printed circuit board 53 attached to the inside surface of the side wall 63 of the auxiliary compartment 16 so that the electric fields of the sensors 61 and 62 are altered by the presence or absence of water or other liquid along the portions of the outer surface of the wall 63 that are directly adjacent the sensors. The electric-field sensors 61 and 62 are preferably of the type described in U.S. Pat. Nos. 6,320,282, 6,310,611 and 5,594,222 assigned to TouchSensor Technologies, LLC and Integrated Controls. Circuit boards containing such sensors are available from TouchSensor Technologies, LLC. For example, circuit board Part No. 000600384-01, modified to convert from stuttering operation to continuous operation, is suitable for use as the circuit board 53 in the illustrative embodiment of the present invention.

Figure 18:
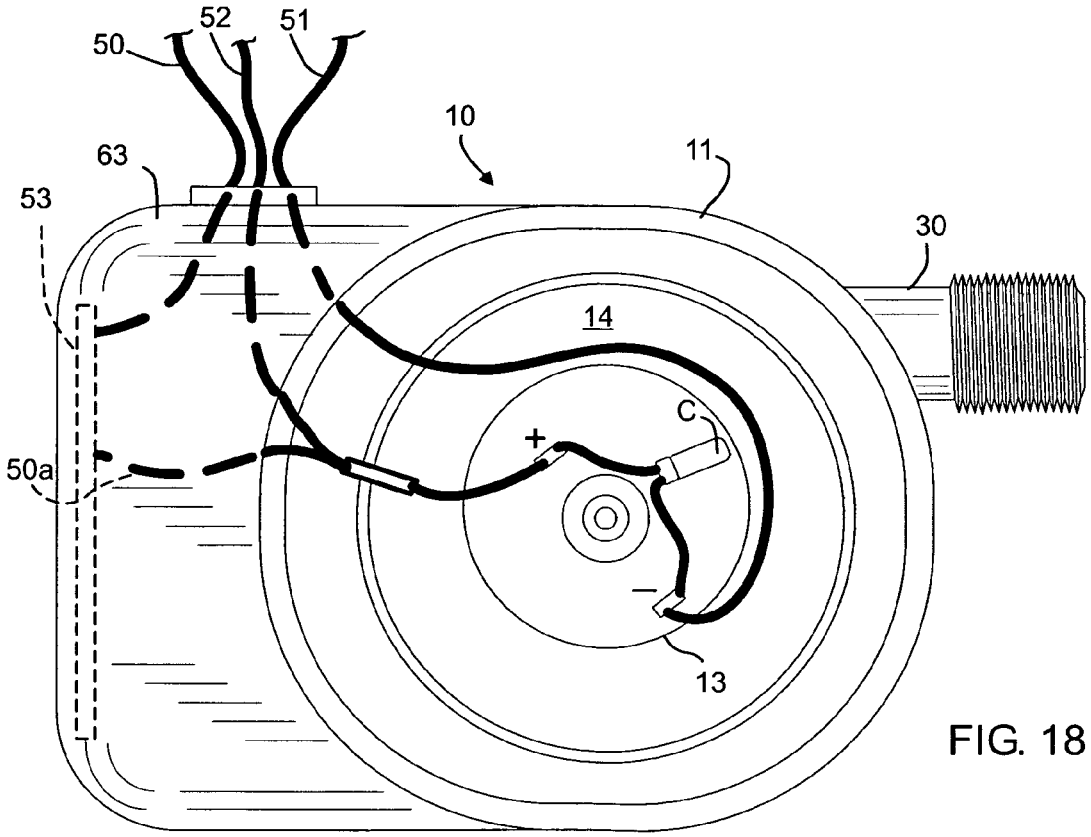
FIG. 18 is an enlarged top plan view of the pump of FIG. 1 with the top cover plate removed.

The electric-field sensors 61 and 62 are located at different elevations (see FIGS. 10-13 and 17). The upper sensor 61 produces a signal that renders the switch 60 conductive to energize the drive motor 13 by connecting it to a battery B when the surface of the liquid body rises to the first predetermined elevation, illustrated in FIG. 10, and the lower sensor 62 produces a signal that renders the switch non-conductive to de-energize the drive motor 13 by disconnecting it from the battery B when the surface of said liquid body drops to the second predetermined elevation, illustrated in FIG. 11. The wire 50*a* from the switch 60 and wire 51 from the negative terminal of the battery B are connected to the power-input terminals 13*a* and 13*b* of the motor 13 at the upper end of the motor 13 in the liquid-tight upper end of the main compartment 12 (see FIG. 18). The wire 50*a* passes through the aperture 55 near the top of the wall that divides the main and auxiliary compartments 12 and 16. The third wire 52 is spliced to the wire 50*a* and passes out through the grommet 57 for connection to a manual override switch described below. A capacitor C is connected across the terminals of the drive motor 13 to suppress spurious high-frequency signals produced during operation of the motor.

Figure 10:
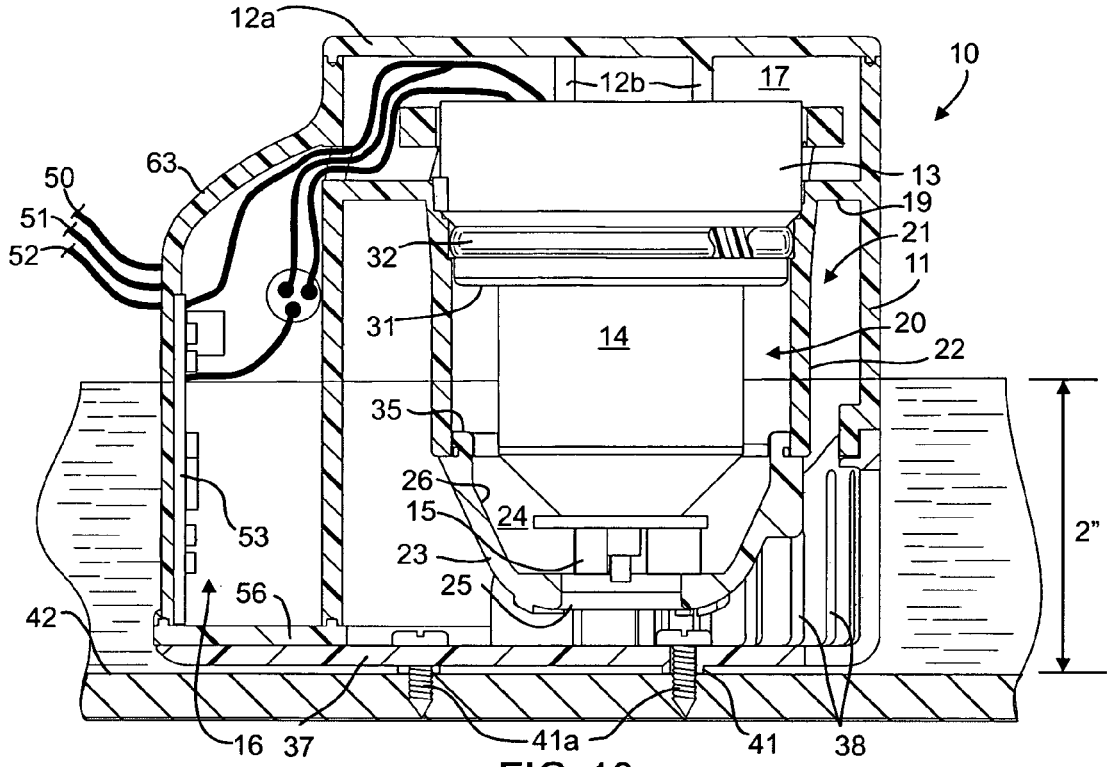
FIG. 10 is the same section shown in FIG. 8 with all the parts of the pump assembled in the body.

As depicted in FIG. 10, when the liquid level 64 of a liquid body 65 rises to the elevation of the upper sensor 61, the output signal from this sensor changes. This change in the output signal activates a time delay circuit 66 which renders the switch 60 conductive if the change in the sensor output signal persists for a preselected time interval (e.g., 3 to 4 seconds) determined by the delay circuit 66. The delay prevents undesired activation of the switch 60 and drive motor 13 in response to intermittent changes in the elevation of the liquid level caused by, for example, sloshing of the liquid body (such as occurs in a boat bilge when the boat bounces or changes speed). When the change in the sensor output signal persists for the prescribed delay interval, the switch 60 is rendered conductive to turn on the drive motor 13, which in turn rotates the impeller 15 to expel liquid from the bilge or other container for the liquid body 65.

Figure 11:
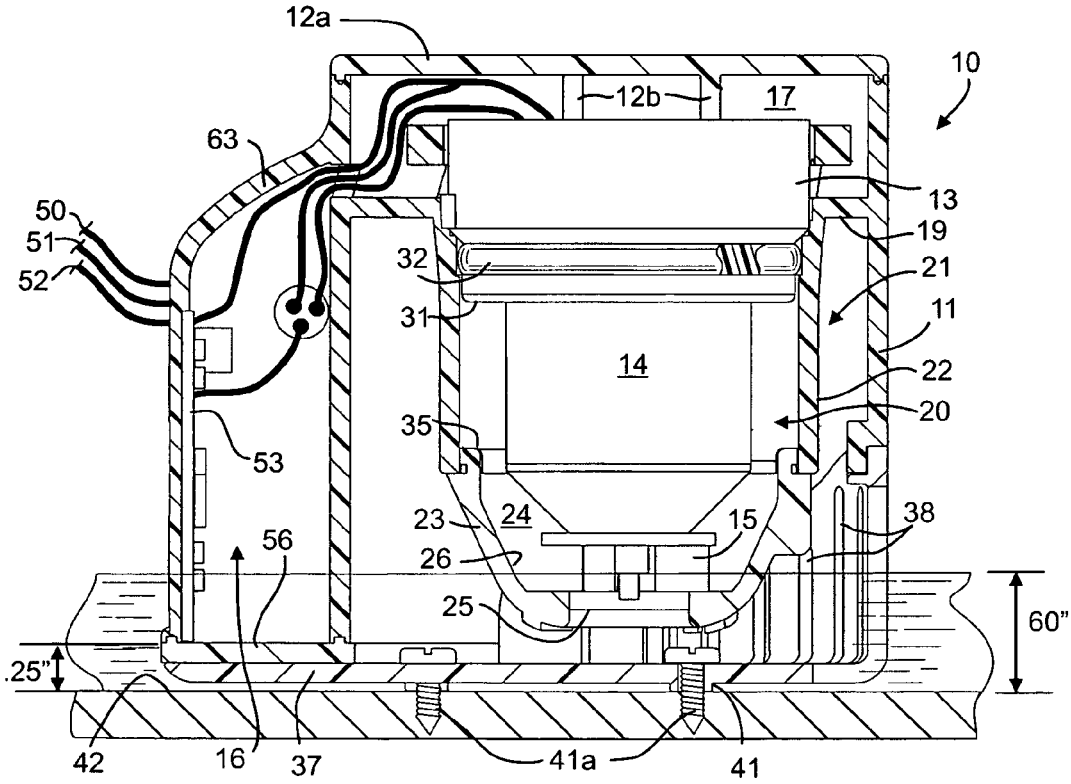
FIG. 11 is the same section shown in FIG. 9 with all the parts of the pump assembled in the body.
Figure 12:
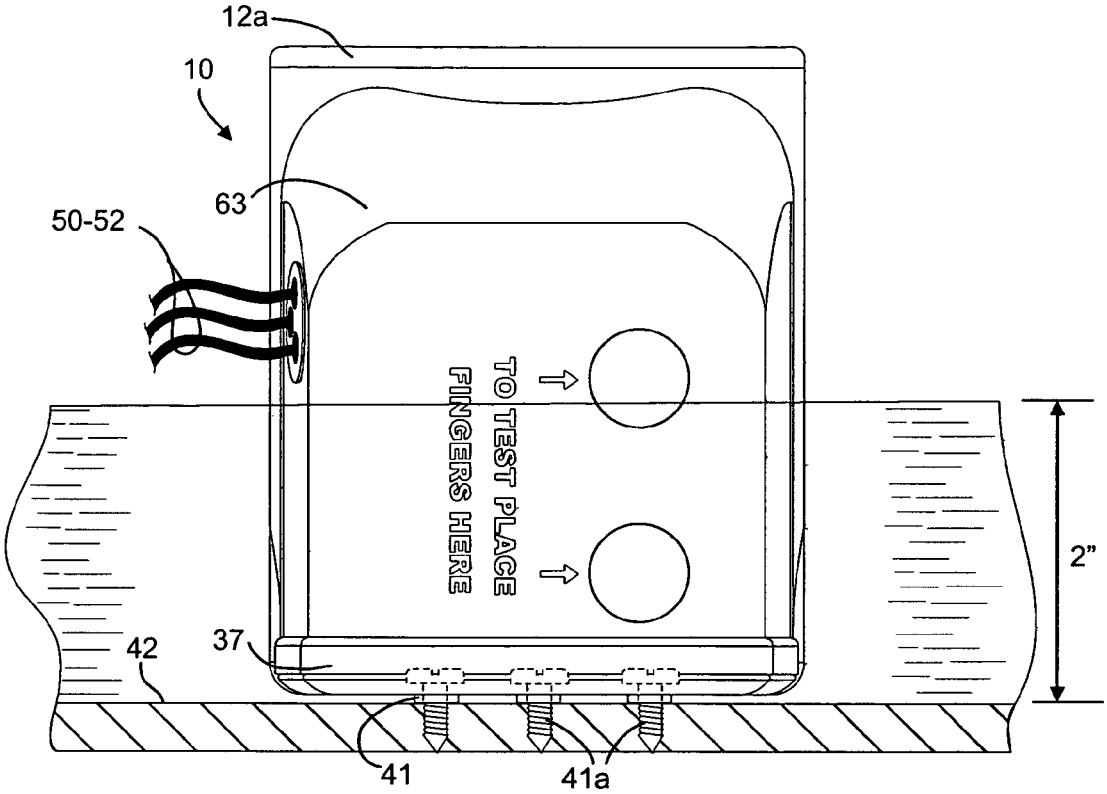
FIG. 12 is an enlarged side elevation of the pump of FIG. 1 partially submerged in a body of liquid.
Figure 13:
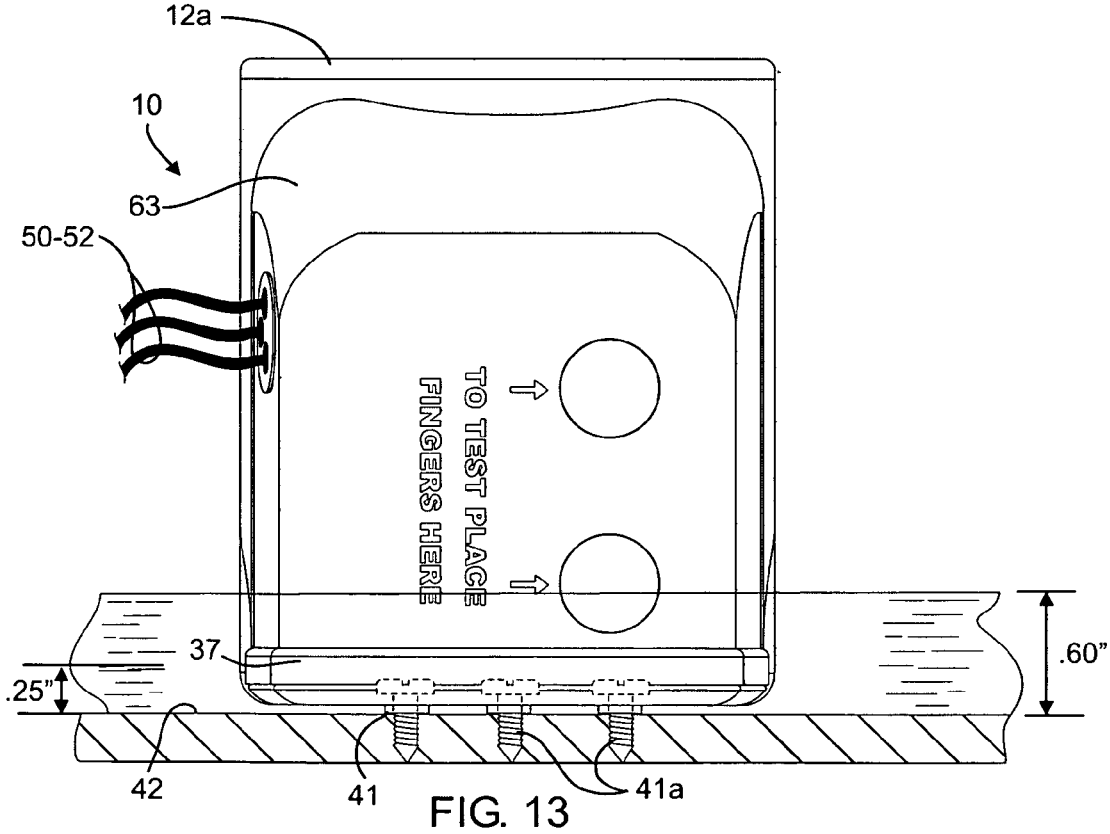
FIG. 13 is the same side elevation shown in FIG. 12 showing a reduced body of liquid.

As liquid is expelled by the pump, the liquid level 64 drops, eventually dropping to the level of the lower sensor 62 (see FIG. 11). The removal of liquid from that portion of the outer surface of the wall 63 adjacent the lower sensor 62 causes a change in the output signal of that sensor, which is used to render the switch 60 non-conductive and thereby turn off the motor 13. The lower sensor 62 is preferably located at an elevation that causes the motor 13 to be turned off at a liquid level about 0.6 inch above the bottom surface of the strainer 37, which is sufficient to avoid any danger of cavitation of the pump. One of the advantages of the electric-field sensors is that they allow the liquid level to be pumped down to a level relatively close to the lowermost surface of the pump. In addition, the sensors and the circuitry to which they are connected can be tested without the use of a body of liquid, by simply placing a human finger where the liquid level should be to change the output signals of the sensors (the water in the human finger affects the electric fields of the sensors in the same way as a body of water).

To permit the drive motor 13 to be turned on and off manually, independently of the switch controlled by the signals from the sensors 61 and 62, a manual override switch 67 is connected between the positive terminal of the battery B and the corresponding terminal of the drive motor 13. This override switch 67 is shown in the electrical schematic diagram in FIG. 14. When the override switch 67 is closed, power from the battery B is supplied directly to the drive motor 13 to turn the drive motor on. Opening the switch 67 turns the motor 13 off.

Figure 15:
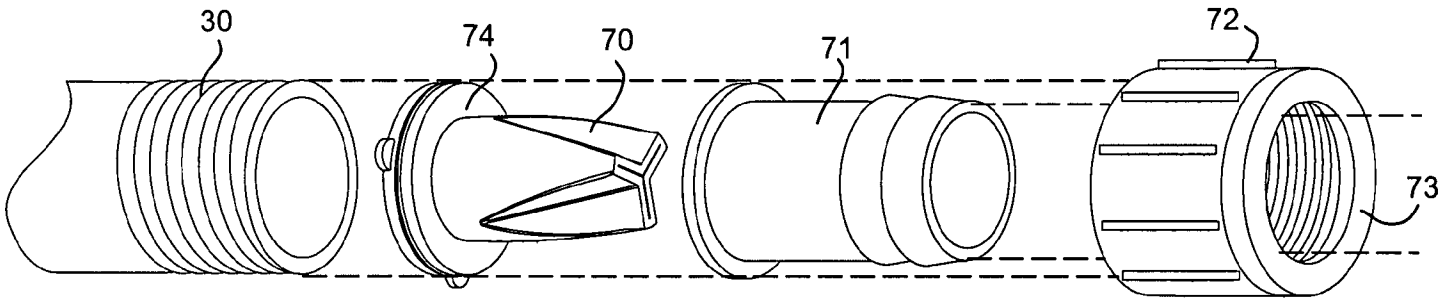
FIG. 15 is an exploded perspective of the discharge spout of the pump of FIG. 1 with a check valve to be attached to the spout.

In the illustrated pump, the end portion of the discharge spout 30 is threaded on its outer surface for receiving a check valve of the type illustrated in FIG. 15. A resilient valve element 70 is seated against the end of the spout 30, inside a telescoping outer tube 71. An internally threaded sleeve 72 is threaded onto the spout 30 so that a flange 73 on the outer end of the sleeve 72 presses the tube 71 against a flange 74 at the base of the valve element 70 to capture both the valve element 70 and the tube 71 and hold them in place against the end of the spout 30. When the pump is operating, the pressure generated by the pump forces the valve element 70 to open to allow the liquid expelled by the pump to exit the spout 30. When the pump ceases operation, the valve element 70 closes and cannot be opened by any liquid pressure applied from outside the pump.

Figure 16:
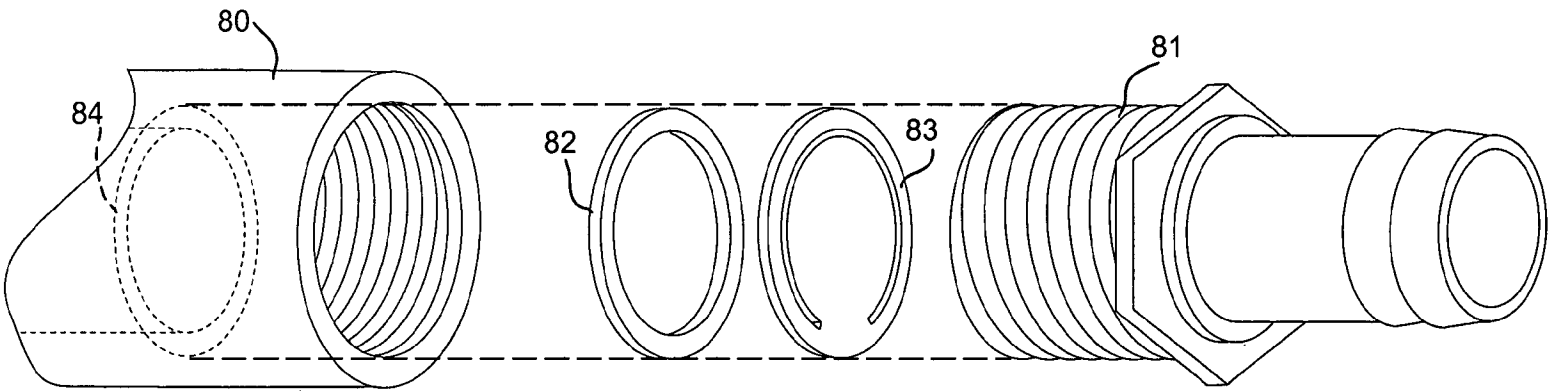
FIG. 16 is an exploded perspective of a modified discharge spout and check valve.
Figure 17:
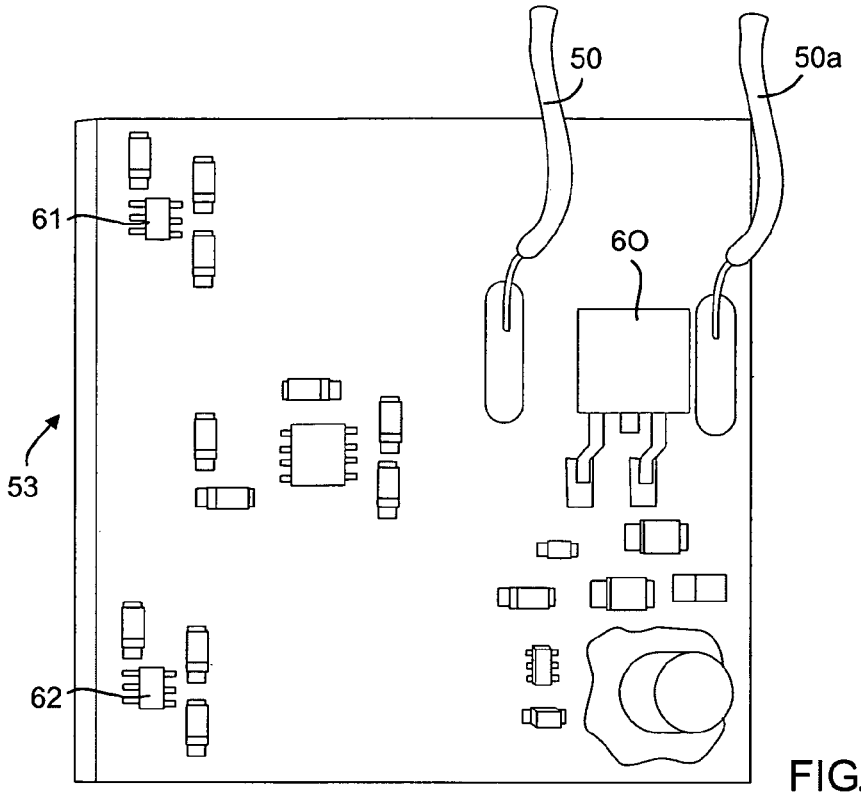
FIG. 17 is an enlarged side elevation of the printed circuit board installed in the pump of FIG. 1.

In an alternative embodiment illustrated in FIG. 16, an enlarged spout 80 is internally threaded to receive an externally threaded sleeve 81. A metal washer 82 and a resilient valve element 83 are captured between the end of the sleeve 81 and a shoulder 84 formed in the interior wall of the spout 80. When the pump is operating, the pressure generated by the pump forces the valve element 83 to open to allow the liquid expelled by the pump to exit the spout 80. When the pump ceases operation, the valve element 83 closes and cannot be opened by any liquid pressure applied from outside the pump.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A submersible pump, comprising:

a pump body forming a main compartment having liquid intake and discharge openings, said pump body being adapted for submersion in a body of liquid whose level is to be controlled, a drive motor in said main compartment, an impeller coupled to the lower end of said drive motor for ejecting liquid through said discharge opening when said impeller is rotated by said drive motor, a sealed liquid-tight auxiliary compartment formed as an integral part of said pump body and located to be at least partially submerged in said liquid body, at least one electric-field sensor mounted on a circuit board, said circuit board being enclosed entirely within said sealed auxiliary compartment and attached to an inner surface of an outer wall of said sealed auxiliary compartment for producing an electric field that extends through said outer wall into the space adjacent the outer surface of said outer wall for detecting changes in the electric field of said sensor caused by a change in the elevation of the surface of said liquid body adjacent a portion of the outer surface of said sealed auxiliary compartment directly adjacent said sensor, a pair of electrical conductors for coupling said electric-field sensor and said drive motor to a power supply, a controllable switch coupled to at least one of said pair of electrical conductors for controlling the supply of electrical power to said drive motor, said electric-field sensor being connected to said controllable switch for turning said drive motor on and off in response to changes in the detected elevation of the surface of said liquid body adjacent the outer surface of said sealed auxiliary compartment, a detachable volute at the lower end of said main compartment to facilitate access to said impeller, and mechanical connectors formed as integral parts of said pump body and said volute for detachably attaching said volute to said pump body, said connectors including cam surfaces for drawing said volute tightly against said pump body as said volute is attached to said pump body.

2. The submersible pump of claim 1, in which said at least one electric-field sensor comprises upper and lower electric-field sensors located at different elevations, the upper sensor producing a signal for turning said drive motor on after the surface of said liquid body rises to a first predetermined elevation, and the lower sensor producing a signal for turning said drive motor off when the surface of said liquid body drops to a second predetermined elevation.

3. The submersible pump of claim 2 wherein said second predetermined elevation is less than about 0.7 inch above the lowermost surface of said pump.

4. The submersible pump of claim 2 wherein said electric-field sensors are mounted on a printed circuit board attached to the inside surface of an outer wall of said auxiliary compartment.

5. The submersible pump of claim 4 wherein at least one of said pair of electrical conductors passes through a sealed aperture in a wall of said auxiliary compartment and is electrically connected to a conductor on said printed circuit board.

6. The submersible pump of claim 4 wherein said controllable switch is mounted on said printed circuit board, and which includes electrical conductors connecting said controllable switch to the upper end of said drive motor.

7. The submersible pump of claim 1 which includes a manual override switch for connecting said drive motor directly to a power supply, bypassing said controllable switch.

8. The submersible pump of claim 1 wherein said connectors are flanged tabs extending upwardly from the top edge of said volute, and cooperating lugs on said pump body for engaging said flanged tabs as said volute is rotated relative to said pump body, at least one of the engaging surfaces of said flanged tabs and lugs forming said cam surfaces.

9. The submersible pump of claim 8 wherein said drive motor is contained in a motor housing surrounded by an O-ring that engages an opposed surface of said main compartment to form a liquid-tight seal between upper and lower regions of said main compartment.

10. The submersible pump of claim 8 wherein said upper portion of said main compartment above said O-ring is sealed against the entry of liquid.

11. The submersible pump of claim 1 which includes a strainer detachably attached to the lower end of said pump body to prevent large solid material from entering said main compartment.

12. The submersible pump of claim 11 wherein the lower portion of said strainer is tapered inwardly to reduce the footprint of said strainer so as to facilitate the mounting of said pump in cramped spaces.

13. The submersible pump of claim 1 which includes a spout extending outwardly from said discharge opening and a check valve mounted on said spout.

* * * * *